US005762264A

United States Patent [19]

Ginsberg

[11] Patent Number: 5,762,264

[45] Date of Patent: Jun. 9, 1998

[54] MAIL INDICATOR

[76] Inventor: Guenter A. Ginsberg, 6 Mischief La., Lake Wylie, S.C. 29710

[21] Appl. No.: 714,419

[22] Filed: Sep. 16, 1996

[51] Int. Cl.[6] ..... B65D 91/00

[52] U.S. Cl. ..... 232/35; 232/17

[58] Field of Search ..... 232/35, 17, 34

[56] References Cited

U.S. PATENT DOCUMENTS

| | | | |
|---|---|---|---|
| 3,490,411 | 1/1970 | Poindexter | 232/35 |
| 3,516,383 | 6/1970 | Goodman | 232/35 |
| 3,620,443 | 11/1971 | Sturtz | 232/35 |
| 4,000,487 | 12/1976 | Duis | 232/35 |
| 4,685,612 | 8/1987 | Rascov | 232/35 |
| 4,711,391 | 12/1987 | Roge et al. | 232/35 |
| 5,123,590 | 6/1992 | Teele | 232/35 |

*Primary Examiner*—Blair Johnson

[57] ABSTRACT

The present invention relates to a mail indicator (10) which comprises a flag (12) which comprises a flag indicator (12A) securely attached at a top distal end of a flag return means (12C) which is securely attached at a bottom distal end to a flag base (12B). The flag indicator (12A) is three dimensional functioning as omnidirectional viewable. The mail indicator (10) further comprises a flag anchor (16) securely attached at a proximal end to the flag base (12B) by a flag base fastener (12BA). The lag anchor (16) further comprises a flag anchor notch (16A) positioned in a open outwardly facing direction at a distal end. The flag anchor (16) is securely fastened to a top front end in a perpendicular position of a mail box receptacle (18B) of a mail box (18), after an user removes mail from the mail box (18). The user bends down the flag indicator (12A) until the flag return means (12C) engages into the flag anchor notch (16A) releasably holding the flag indicator (12A) in a downward position therein, when a mailman opens a mail box door (18A) to place mail within the mail box (18), a top end of the mail box door (18A) hits a flag indicator (12A) thereby disengaging the flag return means (12C) which in turn presents the flag indicator (12A) in an upright position which indicates to the user that new mail has arrived. The flag anchor (16) is securely fastened in a perpendicular configuration to a horizontal fastener (14A) which is securely fastened to the top front end of the mail box receptacle (18B). The flag anchor notch (16A) is angled in a range from five to twenty-five degrees in relation to the flag anchor (16), the angle functions to retain the flag return means (12C) fastened therein. The flag anchor notch (16A) is angled fifteen degrees in a direction toward the proximal end.

11 Claims, 3 Drawing Sheets

MAIL INDICATOR

BACKGROUND OF THE INVENTION

1. Field of the Invention

The present invention relates to a mail indicator positioned at a top front end of a mail box receptacle which is used in conjunction with or as a replacement of a standard mail box mail flag. More particularly, the present invention relates to a mail indicator having a flag indicator positioned atop of a flag return means which is bent over releasably engaging a flag anchor notch within a flag anchor. When a mailman opens a mail box door, a top end thereof hits the flag indicator disengaging the flag return means standing the mail indicator in an upright position which indicates to an user that new mail has arrived.

2. Description of the Prior Art

Prior art inventions range in varying shapes, sizes and configurations. However, all lack one or more of the unique features of the present invention.

Numerous innovations for mail indicator have been provided in the prior art that are described as follows. Even though these innovations may be suitable for the specific individual purposes to which they address, they differ from the present invention as hereinafter contrasted.

In U.S. Pat. No. 4,720,042, titled Mailbox with Door Actuated Signal Flag, invented by Wilbur F. Tapy, a mailbox open at one end with a door sized and configured for closing the open end hingedly attached at its lower edge to the lower edge of the open end. An elongate signal arm is pivotally attached at its lower end to one side of the mailbox to permit frictionless pivotal movement of the signal arm in a plane parallel to the one side of the mail box. A pivot stop pin is attached to the one side of the mailbox to engage and stop the signal arm first and second orientation, in the first half of which the signal arm is reclined away from the open end of the mailbox, and in the second of which the signal arm is orientated upwardly and disposed in an over-center condition with respect to the pivot. A chain is connected at one end to the signal arm at a location away from the pivot and connected to the other end to the door at a location away from the hinge, the connection locations and length of the chain being such that the signal arm can be reclined in the first orientation when the door is closed and such that the signal arm is drawn from the first orientation to the second orientation as the door is opened. The length of the chain is sufficient to permit the door to be rotated about its hinge from the closed position to a filly opened position in which the door hangs vertically below the hinge.

The patented invention differs from the present invention because the patented invention connects a flexible link to a flag from the door. The flag is not spring loaded but is pulled to a vertical position by the opening of the door. The present invention is released by the opening of the mailbox door, which allows the flag to spring upwardly indicating to an observer that mail is in the mail box.

In U.S. Pat. No. 4,390,122, titled Automatic Signal Flag Attachment for a Mailbox, invented by Michael J. Savko an automatic signal attachment for a mailbox which automatically raises a signal flag to indicate that the mailbox door has been opened. The attachment comprises a lever and pivot assembly for the existing signal flag and a trigger clip and spring assembly to activate the signal flag to a vertical position. The attachment can be used on any standard mailbox now in use.

The patented invention differs from the present invention because the patented invention comprises a spring pulling on a lever having an spring attachment on one end and a flag on the opposite distal end. The lever is pivoted about a central point. The present invention has a catch which holds a doubled over spring having a flag on one end, which is released by the opening of the mailbox door. The flag springs upwardly in your invention whereas the flag is pulled to the vertical by the patented invention.

In U.S. Pat. No. 4,883,223, titled Mailbox Signal Flag System, invented by George Taniguchi, a mailbox flag system having mail waiting flag and mail delivered flag connected by control arms and to mailbox door. Expansion slots are provided for slidable engagement with flag pivot pins of control arms and to pivotally rotate mail waiting flag and mail delivered flag around base pivot pins from horizontal down positions to extended vertical positions from where mailbox waiting flag and mail delivered can each drop into channel frame assemblies. When mailbox door is re-shut, control arm flag pivot pin slides up expansion slot and mail delivered flag remains vertical. Mail waiting flag is further provided with an arcuate extension slot attached to expansion slot, when door is re-shut, flag pivot pin slides from expansion slot to arcuate extension slot, engaging the end thereof, lifting mail waiting flag from channel assembly and rotating it back to the horizontal down position.

The patented invention differs from the present invention because the patented invention requires modification by drilling holes in the mailbox to add the patented invention. The present invention does not require modification of the mail box other than clamping it on to the upper rim of the door opening. The patented invention raises the flag as the door is opened by pulling the flag up with rigid rods. The flag is cantilevered so that as the door is closed the weight of the flag causes it to remain up. To return the flag to a reset position it is manually rotated around a pivot point to a closed position. The flag is best seen from the side. The present invention can be clearly seen from the back as well as the side.

In U.S. Pat. No. 5,082,170, titled Mailbox Signal Flag, invented by D. Leroy Goss, a device is provided for automatically signaling the opening of the door of a conventional mailbox. The device consists of stationary member that pivotally intersects with a signal member. The stationary member attaches to the mail box using existing holes intended to accommodate a conventional manually operated mailbox flag. A torsion spring housed within the device causes the signal member to be urged to a vertical position when the door of the mailbox is opened.

The patented invention differs from the present invention because the patented invention uses the mail waiting flag holes for mounting. The patented invention has a spiral or straight spring placed attached to a pivoting flag and the side of the mailbox. When the user wishes to arm the signal flag, the door is closed and the flag is pulled down to engage a trigger means. This tensions the spring. When the door is opened the flag is released, the tension of the spring pivots the flag about an axil until the flag is upright. The flag is flat and aligned with the long axis of the mailbox, making the flag difficult to see from behind. The present invention clamps to the mailbox, so that it does not require modification to the mailbox. The flag, described in the present invention, is a three dimensional shape having good visibility from all sides.

In U.S. Pat. No. 5,366,148, titled Mailbox and Signal, invented by Harold C. Schreckengost, a mailbox having a door and a signal device to indicate that the door has been opened when a mail carrier puts mail in the mailbox. The signal is urged to and held in a erect position by helical spring fixed to a side of the mailbox at one end and having a rigid staff inserted in the other end of the helical spring. The door is hinged to the mailbox at its bottom to swing from a vertical to a horizontal position. Cotter pins are provided to support the signal on the box and on the door. Each cotter pin has a ring on it that receives the signal. One of the cotter pins is attached to the door. When the door is opened the ring moves with the door and off the end of the staff thereby releasing the staff and allowing the helical spring to swing the staff to an erect position. A rectangular template is provided for forming holes in the mailbox and the door for the cotter pins. A flag may be attached to the staff.

The patented invention differs from the present invention because the patented invention is fastened to the side of the mailbox using a fastening means. The fastening of the patented invention requires drilling holes in the mailbox side and the door. The present invention does not require modifying by drilling holes the mailbox for installation. The present invention clamps to the mailbox. The flag, described in the present invention, is a three dimensional shape having good visibility from all sides. In the present invention the signal means is pushed out of the holding slot causing the tensioned spring to relax raising the signal means to vertical.

In U.S. Pat. No. 5,273,207, titled Delivered Mail Indication System, invented by Stephen C. Johnson, a small flag indicates when mail has been delivered. The flag or lip is captured between the two latches of the mailbox door. When the mailbox is opened the lip springs upwardly and outwardly. When the mailbox door is closed, the lip or flag of the indicator engages against an upper latch handle, indicating that mail has been delivered. The delivered mail indicator is made of a suitable polymer with a flag appropriately colored for ease of visualization for indicating that mail has been delivered.

The patented invention differs from the present invention because the patented invention has a living hinge to raise the indicator flag to a visible position when the door is opened by a user. The flag is set by inserting it between the upper and lower latches of the mailbox door when the door is closed. Upon opening the door the flag spring upward to a vertical position. The present invention has a elongated spring device attached at one end to the mailbox by mounting means, the opposite end is attached to a three dimensional shape. The spring is doubled over and retained in a hook means. The spring means is pushed out of the hook by the opening of the door causing the three dimensional shape to rise to vertical.

Numerous innovations for a mail indicator have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a mail indicator positioned at a top front end of a mail box receptacle which is used in conjunction with or as a replacement of a standard mail box mail flag. More particularly, the present invention relates to a mail indicator having a flag indicator positioned atop of a flag return means which is bent over releasably engaging a flag anchor notch within a flag anchor. When a mailman opens a mail box door, a top end thereof hits the flag indicator disengaging the flag return means standing the mail indicator in an upright position which indicates to a user that new mail has arrived.

The types of problems encountered in the prior art are other mail indicators are not readily seen from all directions.

In the prior art, unsucessful attempts to solve this problem were attempted namely: flagging systems of varying configurations. However, the problem was solved by the present invention because it is simple and easy to install utilizing a minimal amount of tools without modification to the mail box.

Innovations within the prior art are rapidly being exploited in the field of mail indicating devices.

The present invention went contrary to the teaching of the art which describes and claims varying configurations of flagging, systems.

The present invention solved a long felt need for an omnidirectional mail indicator.

Accordingly, it is an object of the present invention to provide a mail indicator which comprises a flag releasably engageable into a flag anchor notch of a flag anchor.

More particularly, it is an object of the present invention to provide the flag anchor securely attached at a perpendicular position to a front top end of a mail box receptacle.

In keeping with these objects, and with others which will become apparent hereinafter, one feature of the present invention resides, briefly stated, in the flag anchor notch having, a fifteen degree angle to maximize engageability therein.

When the flag is designed in accordance with the present invention, it comprises a flag indicator securely connected at a top distal end of a flag return means which is securely attached at a bottom distal end to a flag base.

In accordance with another feature of the present invention, the flag base is securely attachable to the flag anchor by a flag base fastener.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—mail indicator (10)
12—flag (12)
12A—flag indication (12)
12B—flag base (12)
12BA—flag base fastener (12BA)
12C—flag return means (12C)
14A—horizontal fastener (14A)
14AA—horizontal fastener first horizontal member (14AA)
14AB—horizontal fastener angled member (14AB)
14AC—horizontal fastener second horizontal member (14AC)
14AD—horizontal fastener valley member (14AD)
14AE—horizontal fastener third horizontal member (14AE)
14AF—horizontal fastener vertical member (14AF)
14B—vertical fastener (14B)
14BA—vertical fastener first vertical member (14BA)
14BB—vertical fastener angled member (14BB)
14BC—vertical fastener plateau member (14BC)
14BD—vertical fastener horizontal member (14BD)

14BE—vertical fastener second vertical member (I4BE)
16—flag anchor (16)
16—flag anchor notch (16A)
18—mail box (18)
18A—mail box door (18A)
18B—mail box receptacle (18B)
20—mail box mail flag (20)

DESCRIPTION OF THE PREFERRED EMBODIMENT

Figure 1A:
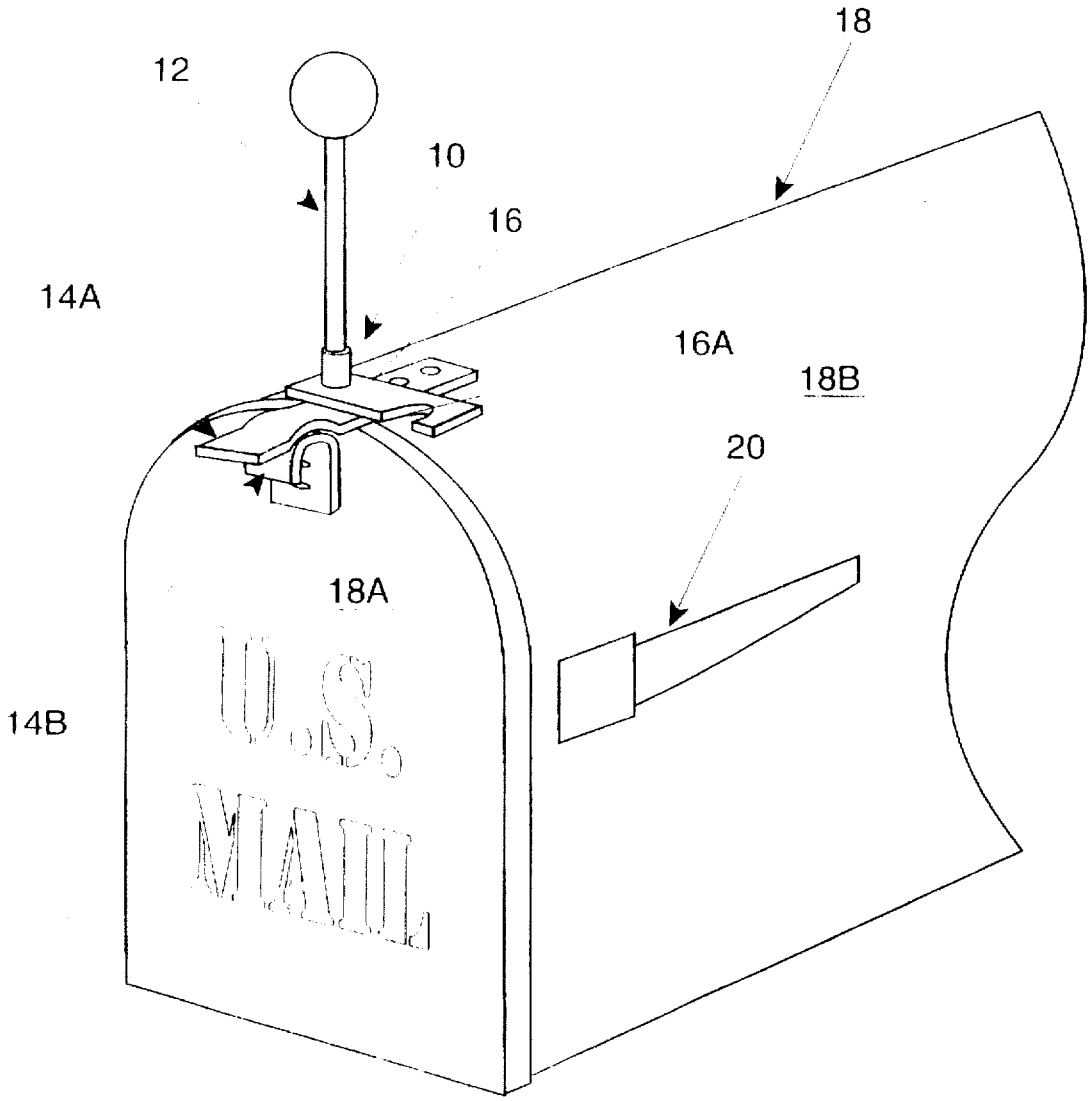
FIG. 1A is a left front top perspective view of a mail indicator exhibiting a flag indicator in an upright position which indicates to an user that new mail is contained within a mail box.
Figure 1B:
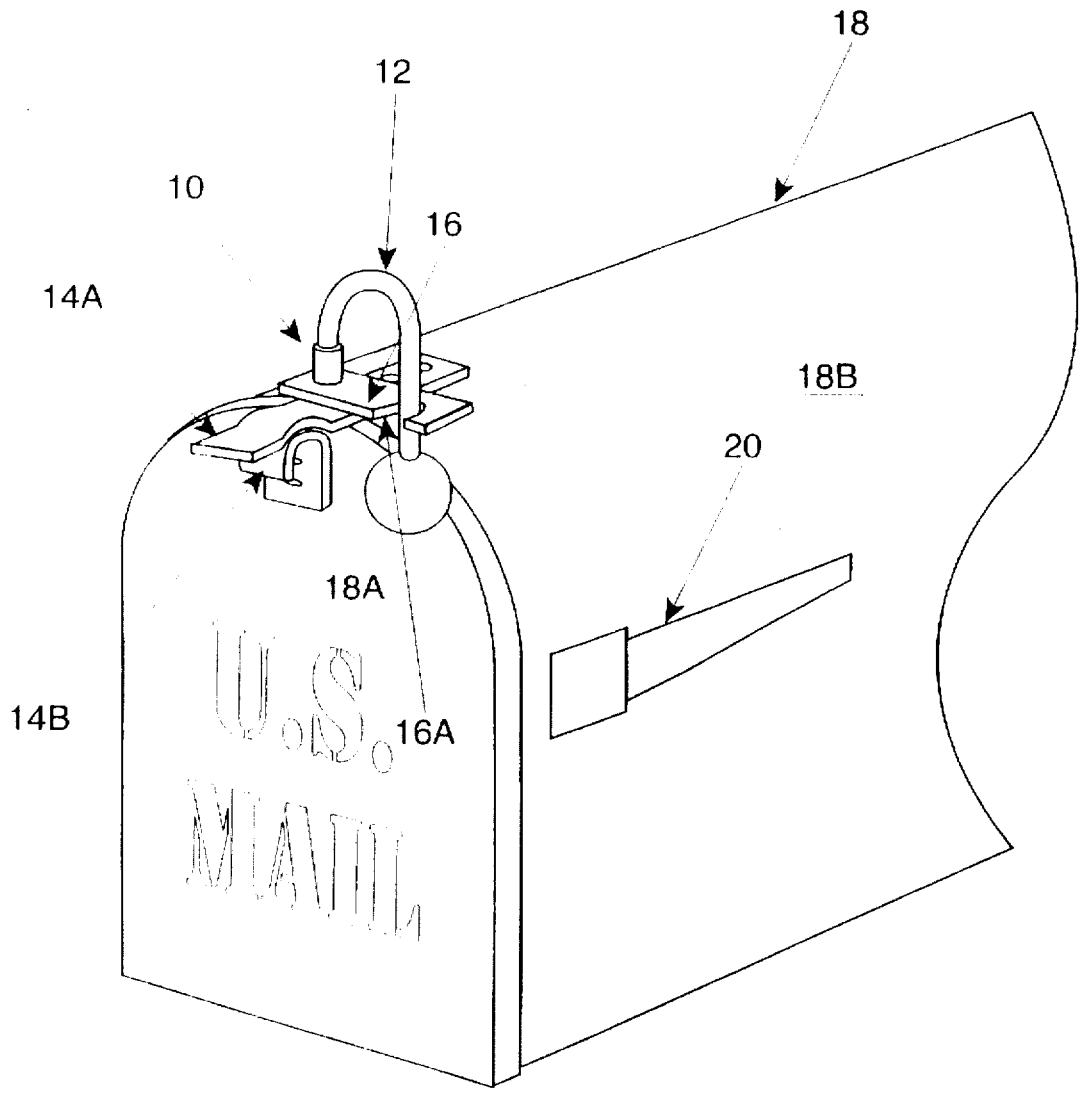
FIG. 1B is a left front top perspective view of a mail indicator exhibiting a flag indicator in an engaged position within a flag anchor notch which indicates to an user that no new mail is contained within a mail box.

Firstly, referring to FIG. 1A which is a left front top perspective view of a mail indicator exhibiting a flag indicator in an upright position which indicates to an user that new mail is contained within a mail box. Referring to FIG. 1B which is a left front top perspective view of a mail indicator exhibiting a flag indicator in an engaged position within a flag anchor notch which indicates to an user that no new mail is contained within a mail box. The mail indicator (10) comprises a flag (12) which comprises a flag indicator (12A) securely attached at a top distal end of a flag return means (12C) which is securely attached at a bottom distal end to a flag base (12B). The flag indicator (12A) is three dimensional functioning as omnidirectional viewable. The mail indicator (10) further comprises a flag anchor (16) securely attached at a proximal end to the flag base (12B) by a flag base fastener (12BA). The lag anchor (16) further comprises a flag anchor notch (16A) positioned in a open outwardly facing direction at a distal end. The flag anchor (16) is securely fastened to a top front end in a perpendicular position of a mail box receptacle (18B) of a mail box (18), after an user removes mail from the mail box (18). The user bends down the flag indicator (12A) until the flag return means (12C) engages into the flag anchor notch (16A) releasably holding the flag indicator (12A) in a downward position therein, when a mailman opens a mail box door (18A) to place mail within the mail box (18), a top end of the mail box door (18A) hits a flag indicator (12A) thereby disengaging the flag return means (12C) which in turn presents the flag indicator (12A) in an upright position which indicates to the user that new mail has arrived. The flag anchor (16) is securely fastened in a perpendicular configuration to a horizontal fastener (14A) which is securely fastened to the top front end of the mail box receptacle (18B). The flag anchor notch (16A) is angled in a range from five to twenty-five degrees in relation to the flag anchor (16), the angle functioning to retain the flag return means (12C) fastened therein. The flag anchor notch (16A) preferably is angled fifteen degrees in a direction toward the proximal end.

Figure 2:
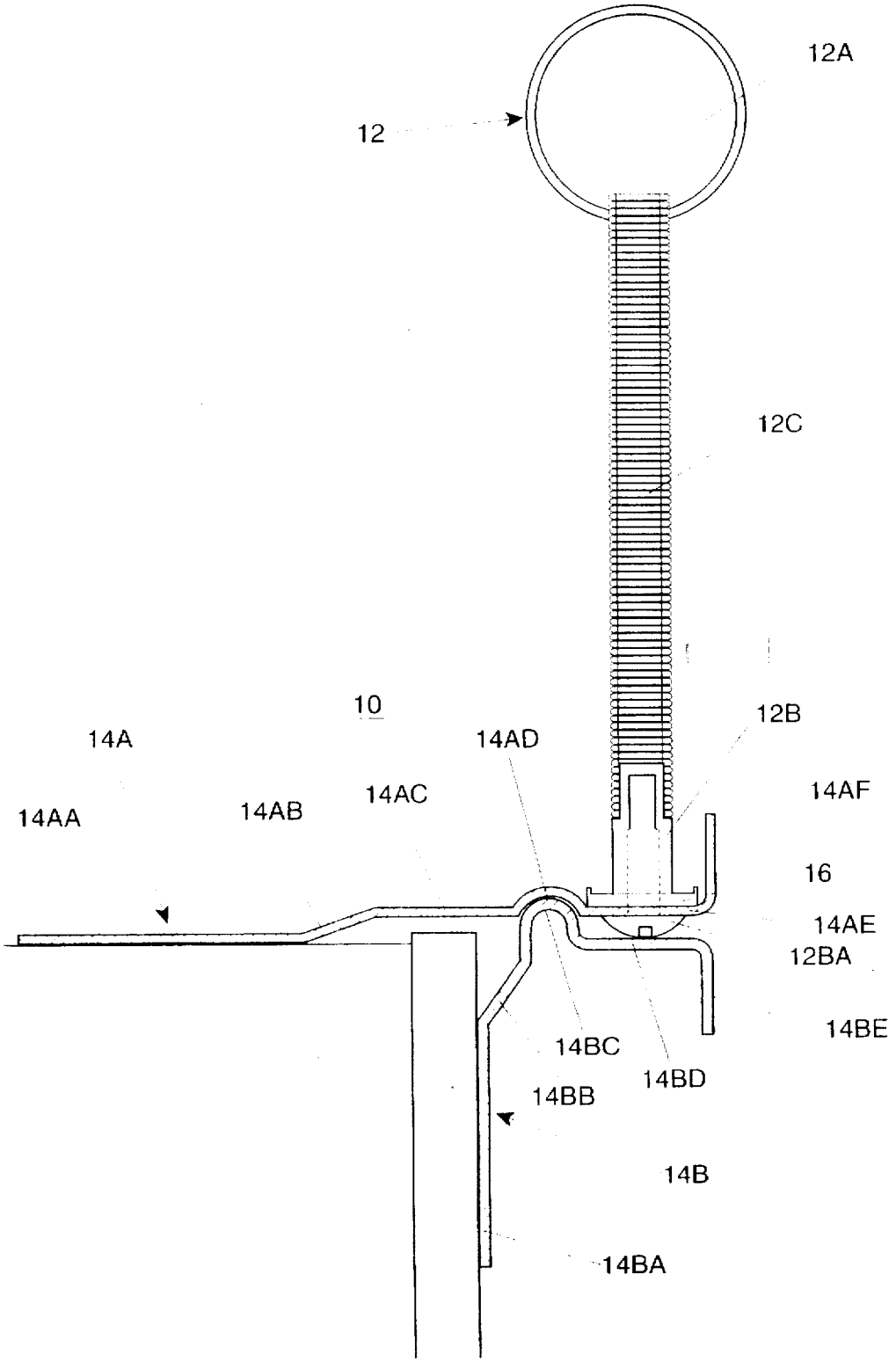
FIG. 2 is a right side view of a mail indicator exhibiting a flag indicator in an upright position.

Referring to FIG. 2 is a right side view of a mail indicator exhibiting a flag indicator in an upright position. The horizontal fastener (14A) comprises a horizontal fastener first horizontal member (14AA) securely attached to the top front end of the mail box receptacle (18B). The horizontal fastener first horizontal member (14AA) is securely fastened at a front distal end to a horizontal fastener angled member (14AB) which is angled in an upward direction functioning to allow clearance of the top end of the mail box door (18A). The horizontal fastener angled member (14AB) is securely fastened at a front distal end to a horizontal fastener second horizontal member (14AC) which is securely fastened at a front distal end to a horizontal fastener valley member (14AD) which is securely fastened at a front distal end to a horizontal fastener third horizontal member (14AE) which is securely fastened at a front distal end to a horizontal fastener vertical member (14AF).

The horizontal fastener (14A) further comprises a complementary vertical fastener (14B) which comprises a vertical fastener first vertical member (14BA) securely attached to a top end of the mail box door (18A). The vertical fastener first vertical member (14BA) is securely attached at an upper end to a vertical fastener angled member (14BB) which is securely attached at an upper end to a vertical fastener plateau member (14BC) which is securely attached at an front end to a vertical fastener horizontal member (14BD) which is securely attached at an front end to a vertical fastener second vertical member (14BE). The horizontal fastener valley member (14AD) and the vertical fastener plateau member (14BC) having a complementary configuration to each other functioning as a releasable locking means between the mail box door (18A) and the mail box receptacle (18B). the horizontal fastener (14B) comprises a "Z" shaped bracket configuration having a horizontal fastener first horizontal member (14AA) which is securely fastened to the top front end of the mail box receptacle (18B), the first horizontal member (14AA) is securely fastened at a front end to a horizontal fastener angled member (14AB) which is securely fastened at a front end to a horizontal fastener second horizontal member (14AC) which is securely fastened at a perpendicular angle to the proximal end of the flag anchor (16).

The flag indicator (12A) is colored a bright color selected from a group consisting of pastel colors, primary colors, and flourescent colors. The flag indicator (12A) is preferably colored yellow. The flag indicator (12A), the flag base (12B), and the flag anchor (16) are constructed from a material consisting of plastic, plastic composite, metal, metal alloy, fiberglass, epoxy, and carbon-graphite. The flag indicator (12A), the flag base (12B), and the flag anchor (16) are preferably constructed from polypropylene. The flag indicator (12A), the flag base (12B), and the flag anchor (16) preferably have a textured surface.

The flag return means (12C) is preferably a spring. The spring is preferably constructed from zinc plated music wire.

It will be understood that each of the elements described above, or two or more together, may also find a useful application in other types of constructions differing from the type described above.

While the invention has been illustrated and described as embodied in a mail indicator, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A mail indicator (10) comprising:

A) a mailbox comprising a receptacle having a front end, a back, a top, a bottom, opposing sides and a door;

B) a flag (12) which comprises a flag indicator (12A) securely attached at a top first end of a flag return means (12C) which is securely attached at a bottom second end to a flag base (12B);

C) a flag anchor (16) securely attached at a proximal end to the flag base (12B) by a flag base fastener (12BA), the flag anchor (16) comprising a rectangular plate and further comprising a flag anchor notch (16A) adjacent a distal end thereof and communicating with an edge of said plate and which opens in an outward direction from said mailbox front, the flag anchor notch (16A) is angled from said edge toward the flag anchor (16) in a range from five to twenty-five degrees in relation to the flag anchor (16) said flag return means being an elongated flexible member and is adapted to engage said notch, the angle functioning to retain the flag return means (12C) fastened within said notch, the flag anchor (16) is securely fastened to the top adjacent said front in a perpendicular position on the mail box receptacle (18B) of a mail box (18), wherein, after a user removes mail from the mail box (18), the flag indicator (12A) until the first end of said flag return means (12C) engages into the flag anchor notch (16A) releasably holding the flag indicator (12A) in a downward position therein, wherein when a mailman opens the mail box door (18A) to place mail within the mail box (18), a top end of the mail box door (18A) is adapted to hit the flag indicator (12A) thereby disengaging the flag return means (12C) which in turn presents the flag indicator (12A) in an upright position which indicates to the user that new mail has arrived, the flag anchor (16) is further securely fastened in a perpendicular configuration to an elongated horizontal fastener (14A) which is securely fastened to the top of said receptacle adjacent said front end of the mail box receptacle the horizontal fastener (14A) comprises a horizontal fastener first horizontal member (14AA) securely attached to the top front end of the mail box receptacle (18B), the horizontal fastener (14A) comprises a "Z" shaped bracket configuration having a horizontal fastener first horizontal member (14AA) which is securely fastened to the top front end of the mail box receptacle (18B) adjacent said front end, the first horizontal member (14AA) is securely fastened at a front end to a horizontal fastener angled member (14AB) which is securely fastened at a front end to a horizontal fastener second horizontal member (14AC) which is securely fastened at a front end to a horizontal fastener valley member (14AD) which is securely fastened at a front end to a horizontal fastener third horizontal member (14E) which is securely fastened at a front end to a horizontal fastener vertical member (14F), said horizontal fastener third horizontal member (14AE) being; securely fastened at a perpendicular angle to the proximal end of the flag anchor (16), the horizontal fastener angled member (14AB) is angled in an upward direction functioning to allow clearance of a top end of the mail box door (18A); the horizontal fastener angled member (14AB) is securely fastened at a front second end to a horizontal fastener second horizontal member (14AC) which is securely fastened at a front second end to a horizontal fastener valley member (14AD) which is securely fastened at a front second end to a horizontal fastener third horizontal member (14AE) which is securely fastened at a front second end to a horizontal fastener vertical member (14AF), the horizontal fastener (14A) is adapted to engage a complementary vertical fastener (14B) which comprises a vertical fastener first vertical member (14BA) securely attached to a top end of the mail box door (18A), the vertical fastener first vertical member (14BA) is securely attached at an upper end to a vertical fastener angled member (14BB) which is securely attached at an upper end to a vertical fastener plateau member (14BC) which is securely attached at an front end to a vertical fastener horizontal member (14BD) which is securely attached at an front end to a vertical fastener second vertical member (14BE), the horizontal fastener valley member (14AD) and the vertical fastener plateau member (14BC) having a complementary configuration to each other functioning as a releasable locking means between the mail box door (18A) and the mail box receptacle (18B).

2. The mail indicator (10) as described in claim 1, wherein the flag indicator (12A) is colored a bright color selected from a group consisting of pastel colors, primary colors, and florescent colors.

3. The mail indicator (10) as described in claim 1, wherein the flag indicator (12A) is colored yellow.

4. The mail indicator (10) as described in claim 1, wherein the flag indicator (12A), the flag base (12B), and the flag anchor (16) are constructed from a material consisting of plastic, plastic composite, metal, metal alloy, fiberglass, epoxy, and carbon-graphite.

5. The mail indicator (10) as described in claim 1, wherein the flag indicator (12A), the flag base (12B), and the flag anchor (16) are constructed from polypropylene.

6. The mail indicator (10) as described in claim 1, wherein the flag indicator (12A), the flag base (12B), and the flag anchor (16) have a textured surface.

7. The mail indicator (10) as described in claim 1, wherein the flag return means (12C) is a spring.

8. The mail indicator (10) as described in claim 7, wherein the spring is constructed from metal wire.

9. The mail indicator (10) as described in claim 7, wherein the spring is constructed from zinc plated music wire.

10. The mail indicator (10) as described in claim 1, wherein the flag anchor notch (16A) is angled fifteen degrees.

11. The mail indicator (10) as described in claim 1, wherein the flag indicator (12A) is three dimensional functioning as omnidirectional viewable.

* * * * *